US010623872B1

(12) United States Patent
Gallo et al.

(10) Patent No.: US 10,623,872 B1
(45) Date of Patent: Apr. 14, 2020

(54) SYSTEMS AND METHODS FOR AUDIO RENDERING CONTROL IN A HEARING SYSTEM

(71) Applicant: SONOVA AG, Staefa (CH)

(72) Inventors: Alessandro Gallo, Murten (CH); Federico Ferrari, Bern (CH)

(73) Assignee: Sonova AG, Staefa (CH)

( * ) Notice: Subject to any disclaimer, the term of this patent is extended or adjusted under 35 U.S.C. 154(b) by 2 days.

(21) Appl. No.: 16/189,390

(22) Filed: Nov. 13, 2018

(51) Int. Cl.
*H04R 25/00* (2006.01)

(52) U.S. Cl.
CPC ..... *H04R 25/554* (2013.01); *H04R 25/552* (2013.01); *H04R 2225/55* (2013.01)

(58) Field of Classification Search
CPC . H04R 25/554; H04R 25/552; H04R 2225/55
USPC ..... 381/315
See application file for complete search history.

(56) References Cited

U.S. PATENT DOCUMENTS 8,054,987 B2 11/2011 Seydoux
9,712,930 B2 * 7/2017 Mustiere ..... H04R 25/554
9,756,434 B2 9/2017 Holm et al.
9,843,871 B1 * 12/2017 Nikookhoy ..... H04R 25/505
2012/0195449 A1 8/2012 Thiede et al.
2018/0206048 A1 * 7/2018 Solum ..... H04R 25/552

* cited by examiner

*Primary Examiner* — Phylesha Dabney

(74) *Attorney, Agent, or Firm* — ALG Intellectual Property, LLC

(57) ABSTRACT

A hearing system includes first and second hearing devices. The first hearing device is configured to render streaming audio from an audio source by establishing a wireless link with the audio source and receiving audio packets transmitted from the audio source over the wireless link in accordance with an acknowledgement-based transmission protocol. The second hearing device is configured to render the streaming audio from the audio source by eavesdropping on the wireless link to receive and store the audio packets in a buffer. The buffer has a playback duration based on a total number of audio packets currently stored in the buffer. To stop the second hearing device from rendering the streaming audio, the first hearing device abstains, for a time period at least equal to the playback duration of the buffer, from acknowledging successful receipt of an audio packet transmitted by the audio source over the wireless link.

20 Claims, 4 Drawing Sheets

SYSTEMS AND METHODS FOR AUDIO RENDERING CONTROL IN A HEARING SYSTEM

BACKGROUND INFORMATION

In some situations, it is desirable for a hearing system that includes first and second hearing devices to render (e.g., acoustically present) streaming audio from an audio source (e.g., a Bluetooth-enabled smartphone) to a user. To this end, the first hearing device may establish a wireless link (e.g., a Bluetooth link) with the audio source and receive audio packets transmitted from the audio source over the wireless link in accordance with an acknowledgement-based transmission protocol. The acknowledgement-based transmission protocol requires the first hearing device to acknowledge successful receipt of an audio packet transmitted by the audio source before the audio source transmits a subsequent audio packet.

For various reasons (e.g., technical limitations, power consumption constraints, etc.), it may be impossible or undesirable for the second hearing device to establish and maintain its own wireless link with the audio source while a wireless link is maintained between the first hearing device and the audio source. In these situations, to facilitate rendering of the streaming audio by the second hearing device, the first hearing device may transmit eavesdropping instructions to the second hearing device by way of a wireless support link that interconnects the hearing devices. The eavesdropping instructions allow the second hearing device to eavesdrop on the wireless link established between the first hearing device and the audio source to receive the audio packets while the audio packets are being transmitted by the audio source over the wireless link. The second hearing device may store the audio packets in a buffer as the audio packets are received and render the audio by playing back the audio packets from the buffer.

At some point, it may be desirable for both the first and second hearing devices to stop rendering the streaming audio. In conventional configurations, this is accomplished by the first hearing device transmitting a stop command to the second hearing device by way of the wireless support link. Upon receipt of the stop command, the second hearing device stops playing back the audio packets from the buffer.

Unfortunately, the wireless support link typically has relatively little bandwidth and relatively high latency. This may delay the second hearing device from receiving and executing the stop command by hundreds of milliseconds (e.g., 300 milliseconds ("ms") or more). This may cause the first and second hearing devices to stop rendering the streaming audio at noticeably different times, which is annoying and undesirable from the user's perspective. Moreover, the wireless support link may become disabled, thereby isolating the second hearing device from the first hearing device. This may make it impossible for the first hearing device to transmit the stop command to the second hearing device.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

Systems and methods for audio rendering control in a hearing system are described herein. For example, a hearing system may include a first hearing device and a second hearing device. The first hearing device is configured to render streaming audio from an audio source by establishing a wireless link with the audio source and receiving audio packets transmitted from the audio source over the wireless link in accordance with an acknowledgement-based transmission protocol. The second hearing device is configured to render the streaming audio from the audio source by eavesdropping on the wireless link to receive the audio packets while the audio packets are being streamed from the audio source over the wireless link and storing the audio packets in a buffer (e.g., as or after the audio packets are received by the second hearing device). The buffer has a playback duration based on a total number of audio packets currently stored in the buffer. To stop the second hearing device from rendering the streaming audio, the first hearing device abstains, for a time period at least equal to the playback duration of the buffer, from acknowledging successful receipt of an audio packet transmitted by the audio source over the wireless link (even though the first hearing device may have successfully received the audio packet).

By abstaining from acknowledging successful receipt of the audio packet transmitted by the audio source over the wireless link, the first hearing device prevents the audio source from transmitting additional audio packets during the time period at least equal to the playback duration of the buffer. This may cause the buffer of the second hearing device to underflow (e.g., empty) once the second hearing device plays back the audio packets already stored in the buffer when the first hearing device begins abstaining from acknowledging successful receipt of the audio packet. This effectively stops the second hearing device from rendering the streaming audio.

As will be described herein, this process of stopping the second hearing device from rendering the streaming audio may be faster and/or more reliable than conventional processes in which a stop command is transmitted from the first hearing device to the second hearing device by way of a wireless support link between the first and second hearing devices. Moreover, the systems and methods described herein may allow the first and second hearing devices to stop rendering streaming audio at substantially the same time, which may minimize or eliminate user discomfort and annoyance associated with conventional processes that result in the first and second hearing devices stopping at different times.

As used herein, the term "audio packet" refers to any sample, portion, or other type of audio data representative of or otherwise associated with streaming audio that is provided by an audio source. An audio packet may be in any suitable format and may be transmitted in any suitable manner.

Figure 1:
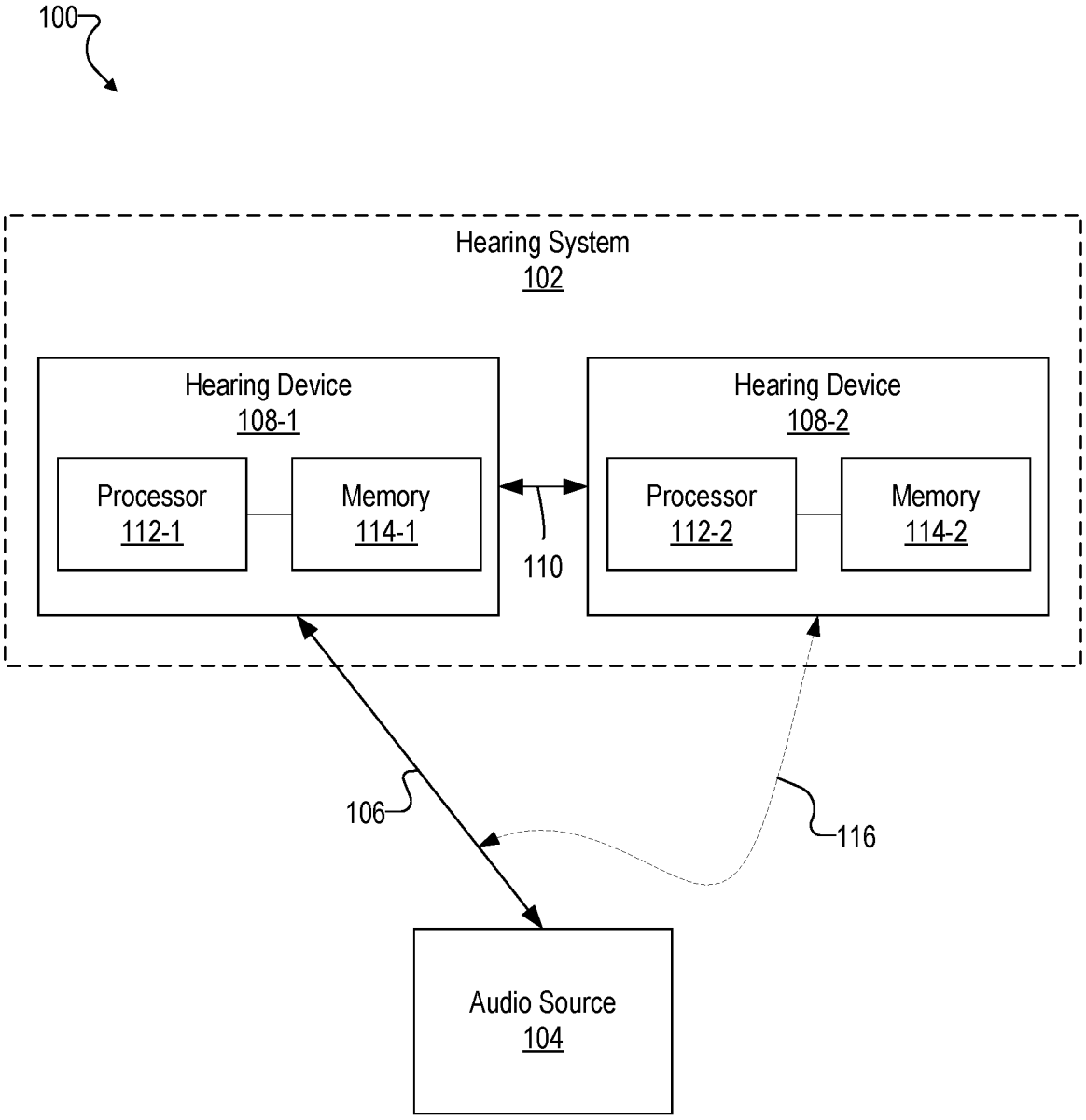
FIG. 1 illustrates an exemplary configuration in which a hearing system is configured to communicate with an audio source by way of a selectively established wireless link according to principles described herein.

FIG. 1 illustrates an exemplary configuration 100 in which a hearing system 102 (e.g., a binaural hearing system) is configured to communicate with an audio source 104 by way of a selectively established wireless link 106. As shown, hearing system 102 includes a first hearing device 108-1 and a second hearing device 108-2 (collectively "hearing devices 108"). Hearing devices 108 may communicate one with another by way of a wireless support link 110. Each element shown in configuration 100 will now be described in detail.

Audio source 104 may include any computing device that outputs streaming audio (e.g., speech, music, or other audio content output) and that is capable of being wirelessly connected with one of hearing devices 108. For example, audio source 104 may be a mobile device (e.g., a mobile phone such as a smartphone, a tablet computer, a laptop computer, a mobile gaming device), a desktop computer, a television, a speaker, etc. As described herein, audio source 104 may wirelessly transmit streaming audio to hearing system 102 in the form of audio packets (e.g., discrete units or pieces of data representative of the streaming audio).

Hearing devices 108 may each be implemented by any type of hearing device configured to provide or enhance hearing to a user of hearing system 102. For example, hearing devices 108 may each be implemented by a hearing aid configured to apply amplified audio content to a user, a sound processor included in a cochlear implant system configured to apply electrical stimulation representative of audio content to a user, a sound processor included in an electro-acoustic stimulation system configured to apply electro-acoustic stimulation to a user, a head-worn headset, an ear-worn ear-bud or any other suitable hearing prosthesis. In some examples, hearing device 108-1 is of a different type than hearing device 108-2. For example, hearing device 108-1 may be a hearing aid and hearing device 108-2 may be a sound processor included in a cochlear implant system.

As shown, each hearing device 108 includes a processor and a memory. For example, hearing device 108-1 includes a processor 112-1 and a memory 114-1. Likewise, hearing device 108-2 includes a processor 112-2 and a memory 114-2.

Processors 112 are configured to perform various processing operations, such as receiving and processing streaming audio transmitted by audio source 104. Processors 112 may each be implemented by any suitable combination of hardware and software.

Memory 114 may be implemented by any suitable type of storage medium and may maintain (e.g., store) data utilized by processors 112. For example, memory 114 may store data representative of an operation program that specifies how each processor 112 processes and delivers audio content to a user. To illustrate, if hearing device 108-1 is a hearing aid, memory 114-1 may maintain data representative of an operation program that specifies an audio amplification scheme (e.g., amplification levels, etc.) used by processor 112-1 to deliver acoustic content output by audio source 104 to the user. As another example, if hearing device 108-1 is a sound processor included in a cochlear implant system, memory 114-1 may maintain data representative of an operation program that specifies a stimulation scheme used by hearing device 108-1 to direct a cochlear implant to apply electrical stimulation representative of acoustic content output by audio source 104 to the user. As will be described below, memory 114 may maintain a buffer within which audio packets received from audio source 104 may be stored.

Hearing devices 108 may communicate with each other (e.g., by transmitting data) by way of a wireless support link 110 that interconnects hearing devices 108. Wireless support link 110 may include any suitable wireless communication link as may serve a particular implementation.

To facilitate communication between hearing system 102 and audio source 104, one of hearing devices 108 may establish a wireless link with audio source 104. For example, as shown in FIG. 1, hearing device 108-1 may establish wireless link 106 with audio source 104. Wireless link 106 may include a Bluetooth link (e.g., a Bluetooth classic link or a Bluetooth low energy link), a near field communication link, or any other suitable point-to-point link. To this end, hearing devices 108 and audio source 104 may each include a wireless interface configured to operate in accordance with any suitable wireless communication protocol.

Hearing device 108-1 may receive audio packets transmitted from audio source 104 over wireless link 106 in accordance with an acknowledgement-based transmission protocol (also referred to as an automatic repeat query ("ARQ") protocol). As will be described below, this may allow hearing device 108-1 to render (e.g., process and play back) streaming audio from audio source 104.

The acknowledgement-based transmission protocol requires hearing device 108-1 to acknowledge successful receipt of an audio packet transmitted by audio source 104 before audio source 104 transmits a subsequent audio packet. Exemplary acknowledgement-based transmission protocols include stop-and-wait ARQ, go-back-N ARQ, and selective repeat ARQ. A Bluetooth communication protocol, for example, may use any of these acknowledgement-based transmission protocols.

It may be desirable for hearing device 108-2 to also render streaming audio from audio source 104 while hearing device 108-1 renders the streaming audio. However, in some examples, hearing device 108-2 cannot or does not establish its own wireless link with audio source 104 while hearing device 108-1 is connected with audio source 104 by way of wireless link 106. For example, the communication protocol used by hearing devices 108 and audio source 104 to establish wireless links therebetween may not allow both hearing devices 108 to be concurrently connected to audio source 104.

In these examples, hearing device 108-2 may receive the audio packets transmitted from audio source 104 by eavesdropping on wireless link 106. This eavesdropping is illustrated by dashed line 116 in FIG. 1. Hearing device 108-2 may eavesdrop on wireless link 106 by passively listening to (e.g., having access to) data traffic (e.g., audio packets) transmitted between audio source 104 and hearing device 108-1. The eavesdropping is done without audio source 104 being aware that hearing device 108-2 is accessing the data traffic and without hearing device 108-2 transmitting any data to audio source 104.

To enable eavesdropping by hearing device 108-2 on wireless link 106, hearing device 108-1 may transmit, over wireless support link 110, eavesdropping instructions to hearing device 108-2. The eavesdropping instructions may include information (e.g., frequency hopping sequence information, clock frequency and phase offset information, encryption key information, address information, etc.) that allows hearing device 108-2 to detect audio packets that are wirelessly transmitted from audio source 104 to hearing device 108-1. Hearing device 108-2 may accordingly use the eavesdropping instructions to eavesdrop on wireless link 106.

Figure 2:
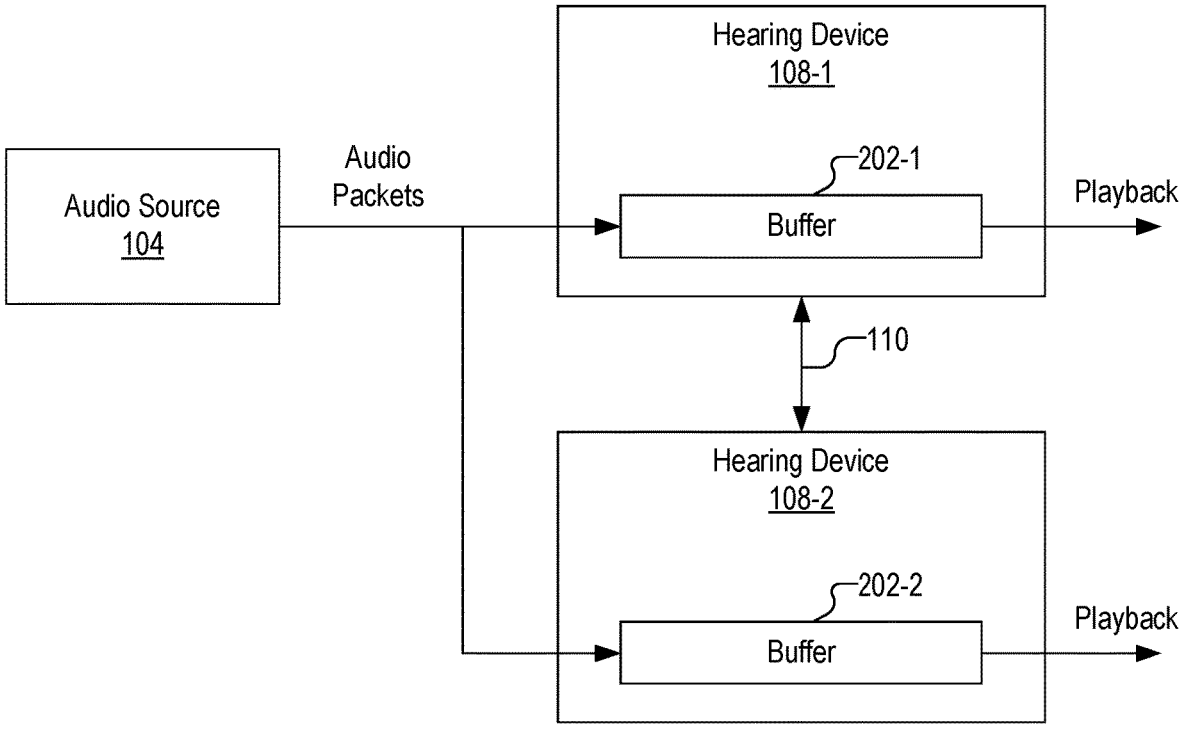
FIG. 2 illustrates an exemplary configuration in which hearing devices included in a hearing system both render streaming audio from audio source according to principles described herein.

FIG. 2 illustrates an exemplary configuration in which hearing devices 108 both render streaming audio from audio source 104. As shown, audio source 104 transmits audio packets, which are received by both hearing device 108-1 and hearing device 108-2. As described in connection with FIG. 1, hearing device 108-1 may receive the audio packets over wireless link 106 and hearing device 108-2 may receive the audio packets by eavesdropping on wireless link 106.

As shown, hearing device 108-1 stores the audio packets in a buffer 202-1. Likewise, hearing device 108-2 stores the audio packets in a buffer 202-2. Buffers 202 may be maintained within memory 114-1 and memory 114-2, respectively, and may each be of any suitable size (e.g., they may each store any suitable number of audio packets).

Hearing devices 108 may render streaming audio from audio source 104 by playing back audio packets stored within buffers 202. For example, hearing device 108-1 may render streaming audio from audio source 104 by playing back audio packets stored within buffer 202-1. Likewise, hearing device 108-2 may render streaming audio from audio source 104 by playing back audio packets stored within buffer 202-2. In so doing, the audio packets that are played back are removed from buffers 202. Hearing devices 108 may use any suitable processing technique to play back audio packets stored within buffers 202.

Playback of audio packets in buffers 202 may occur while additional audio packets are being received and stored within buffers 202. In this manner, buffers 202 may allow continuous rendering of streaming audio from audio source 104 as the audio is generated and transmitted by audio source 104.

Buffers 202 may each have a playback duration based on a total number of audio packets currently stored in each respective buffer 202. For example, buffer 202-1 may have ten audio packets stored therein at a particular point in time. Hence, at this particular point in time, buffer 202-1 has a playback duration equal to an amount of time it takes hearing device 108-1 to play back the ten audio packets. At any given point in time, buffers 202 may have the same or a different number of audio packets currently stored therein. For example, at a particular point in time, buffer 202-1 may include more, less, or the same number of audio packets stored therein compared to the number of audio packets stored in buffer 202-2 at the particular point in time.

An audio packet may be stored in a buffer (e.g., one of buffers 202) in any suitable manner. For example, an encoded and/or compressed version of an audio packet (instead of the audio packet itself) may be stored in a buffer. It will be recognized that compression ratios may change from audio packet to audio packet. Hence, the playback duration of a buffer may be determined using any suitable formula based on the number of audio packets stored within the buffer and/or the manner in which audio packets are stored within the buffer.

Each buffer 202 may have a maximum possible playback duration. The maximum possible playback duration of a particular buffer (e.g., buffer 202-1) is based on the maximum number of audio packets that may be stored within the buffer at any given time. The maximum possible playback duration may be set in software and/or depend on hardware capabilities of memories 114. An exemplary maximum possible playback duration of each of buffers 202 is around 200 ms.

In some examples, hearing device 108-1 may be aware of the playback duration of buffer 202-2. For example, if hearing device 108-1 is the hearing device that establishes wireless connection 106 with audio source 104, hearing device 108-1 may be aware of the playback duration of buffer 202-2 by receiving data from which hearing device 108-1 may derive the playback duration over wireless support link 110. Hearing device 108-2 may likewise be aware of the playback duration of buffer 202-1.

Figure 3:
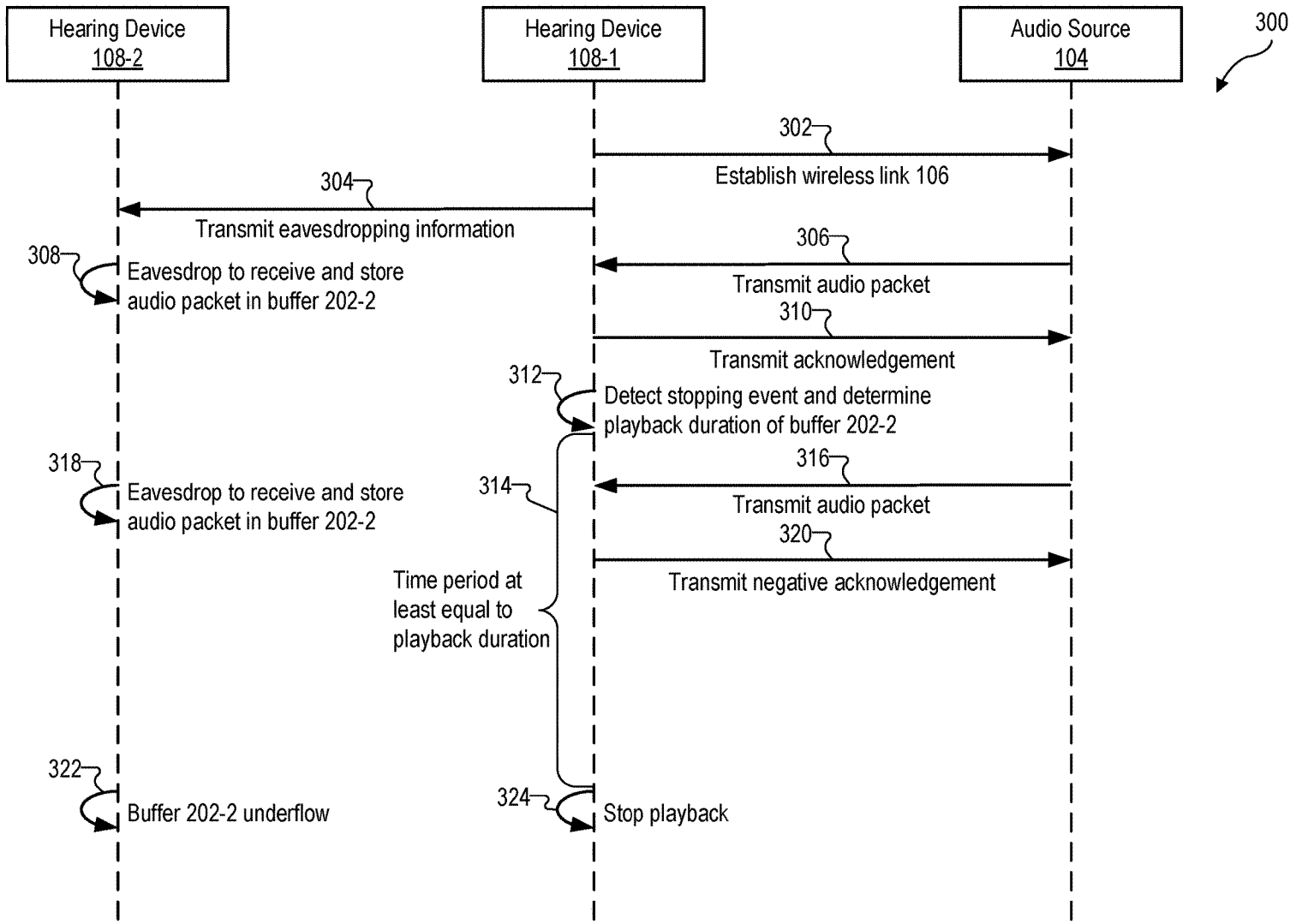
FIGS. 3-4 illustrate exemplary sequence diagrams according to principles described herein.

FIG. 3 shows an exemplary sequence diagram 300 that illustrates various operations that may be performed by hearing devices 108 and audio source 104 in accordance with the systems and methods described herein.

In operation 302, hearing device 108-1 establishes wireless link 106 with audio source 104. This may be performed in any of the ways described herein. Each of the remaining operations between hearing device 108-1 and audio source 104 as shown in FIG. 3 are performed over wireless link 106.

In operation 304, hearing device 108-1 transmits eavesdropping information to hearing device 108-2. This may be performed in any of the ways described herein and is configured to facilitate eavesdropping by hearing device 108-2 on wireless link 106 established between hearing device 108 and audio source 104.

In operation 306, audio source 104 transmits an audio packet to hearing device 108-1. While not illustrated in FIG. 3, hearing device 108-1 stores the audio packet in buffer 202-1.

In operation 308, hearing device 108-2 eavesdrops on wireless link 106 to receive and store, in buffer 202-2, the audio packet transmitted in operation 306. Hearing device 108-2 may eavesdrop on wireless link 106 to receive the audio packet in any of the ways described herein.

In operation 310, hearing device 108-1 transmits an acknowledgment to audio source 104 in response to successfully receiving the audio packet transmitted in operation 306. The acknowledgment may include any suitable data that indicates to audio source 104 that the audio packet is successfully received by hearing device 108-1. For example, the acknowledgment may include data specified in the acknowledgment-based transmission protocol used by hearing device 108-1 and audio source 104 to communicate over wireless link 106.

Operations 306, 308, and 310 may be performed repeatedly for subsequent audio packets output by audio source 104. At some point, as indicated in operation 312, hearing device 108-1 may detect a stopping event. A stopping event may include any event that indicates that hearing devices 108 are to stop rendering the streaming audio from audio source 104.

For example, hearing device 108-1 may detect the stopping event by detecting user input representative of a request to stop listening to the streaming audio from audio source 104. The user input may be provided in any suitable manner (e.g., by pressing a button on hearing device 108-1 and/or audio source 104).

Additionally or alternatively, hearing device 108-1 may detect the stopping event by detecting an underflow of buffer 202-1. The underflow may be caused by a bad wireless link 106, which may be caused by interference, obstacles, and/or distance between hearing device 108-1 and audio source 104.

Additionally or alternatively, hearing device 108-1 may detect the stopping event by detecting the presence of another audio stream (e.g., from another audio source other than audio source 104) to which hearing devices 108 are to switch and begin rendering. To do so, hearing devices 108 must stop rendering the streaming audio from audio source 104.

Additionally or alternatively, hearing device 108-1 may detect the stopping event by detecting an error condition associated with one or both of hearing devices 108 and/or with audio source 104. Such error conditions may include audio decoding errors, excessive drift between a feed rate and a local clock on hearing device 108-1, mismatching controller logic, and/or other status inconsistencies that can derive from temporary excessive latency in wireless support link 110. In these cases, it may be necessary or desirable for both hearing devices 108 to stop rendering the streaming audio from audio source 104 to make sure that buffers 202 are both empty. Once this determination is made, hearing devices 108 may restart buffering and rendering the streaming audio.

In response to detecting the stopping event, hearing device 108-1 may stop hearing device 108-2 from rendering the streaming audio. In conventional configurations, this is accomplished by the hearing device 108-1 transmitting a stop command to hearing device 108-2 by way of wireless support link 110. Upon receipt of the stop command, hearing device 108-2 stops playing back the audio packets from buffer 202-2. However, as mentioned above, wireless support link 110 may have relatively little bandwidth and relatively high latency. This may delay hearing device 108-2 from receiving and executing the stop command by hundreds of milliseconds (e.g., 300 ms or more). This may cause hearing devices 108 to stop rendering the streaming audio at noticeably different times, which is annoying and undesirable from the user's perspective.

Moreover, in some cases, wireless support link 110 may become disabled, thereby isolating hearing device 108-2 from hearing device 108-1. In these cases, hearing device 108-2 may continue to eavesdrop on wireless link 106 and thereby continue receiving and playing back audio packets from audio source 104. Without wireless support link 110, hearing device 108-1 cannot communicate directly with hearing device 108-2, thus making it impossible for hearing device 108-1 to transmit the stop command to hearing device 108-2.

Hence, in accordance with the systems and methods described herein, hearing device 108-1 may stop hearing device 108-2 from rendering the streaming audio by abstaining, for a time period at least equal to the playback duration of buffer 202-2, from acknowledging successful receipt of an audio packet transmitted by audio source 104 over wireless link 106. This may be performed in a variety of different ways.

For example, as illustrated in operation 312, when hearing device 108-1 detects the stopping event, hearing device 108-1 may also determine the playback duration of buffer 202-2. This determination may be made by receiving or accessing data indicating the playback duration of buffer 202-2 from hearing device 108-2 over wireless support link 110.

As indicated by callout 314, hearing device 108-1 abstains from acknowledging successful receipt of an audio packet transmitted by audio source 104 over wireless link 106 for a time period at least equal to the playback duration of buffer 202-2. During this time period, audio source 104 transmits an audio packet to hearing device 108-1, as illustrated in operation 316. In operation 318, hearing device 108-2 eavesdrops on wireless link 106 to receive and store, in buffer 202-2, the audio packet transmitted in operation 316. However, as indicated in operation 320, hearing device 108-1 abstains from acknowledging successful receipt of this audio packet (even though hearing device 108-1 does successfully receive the audio packet) by transmitting a negative acknowledgment to audio source 104 over wireless link 106. The negative acknowledgment may include any data that indicates to audio source 104 that hearing device 108-1 did not successfully receive the audio packet.

Upon receipt of the negative acknowledgment, audio source 104 may abstain from transmitting an additional audio packet to hearing device 108-1 over wireless link 106. Instead, audio source 104 may attempt to retransmit the same audio packet transmitted in operation 316. Hearing device 108-1 may continue to transmit negative acknowledgments in response to these attempted retransmissions by audio source 104, thereby preventing audio source 104 from transmitting (and hearing device 108-2 from receiving) additional audio packets.

The negative acknowledgments may be transmitted by hearing device 108-1 for the time period at least equal to the playback duration of buffer 202-2. During this time period, hearing device 108-2 may play back the audio packets already stored in buffer 202-2. But because hearing device 108-2 is not receiving additional audio packets during this time period, buffer 202-2 will underflow at the completion of the time period (i.e., at the conclusion of the time period, buffer 202-2 does not include any audio packets for hearing device 108-2 to play back), as illustrated in operation 322. This effectively stops hearing device 108-2 from rendering streaming audio from audio source 104. As illustrated by operation 324, at the completion of the time period, hearing device 108-1 may also stop playback of audio packets stored in buffer 202-1. In this manner, hearing devices 108-1 and 108-2 may stop rendering the streaming audio from audio source 104 in a synchronized manner (e.g., at substantially the same time), which is desirable from the user's perspective.

Figure 4:
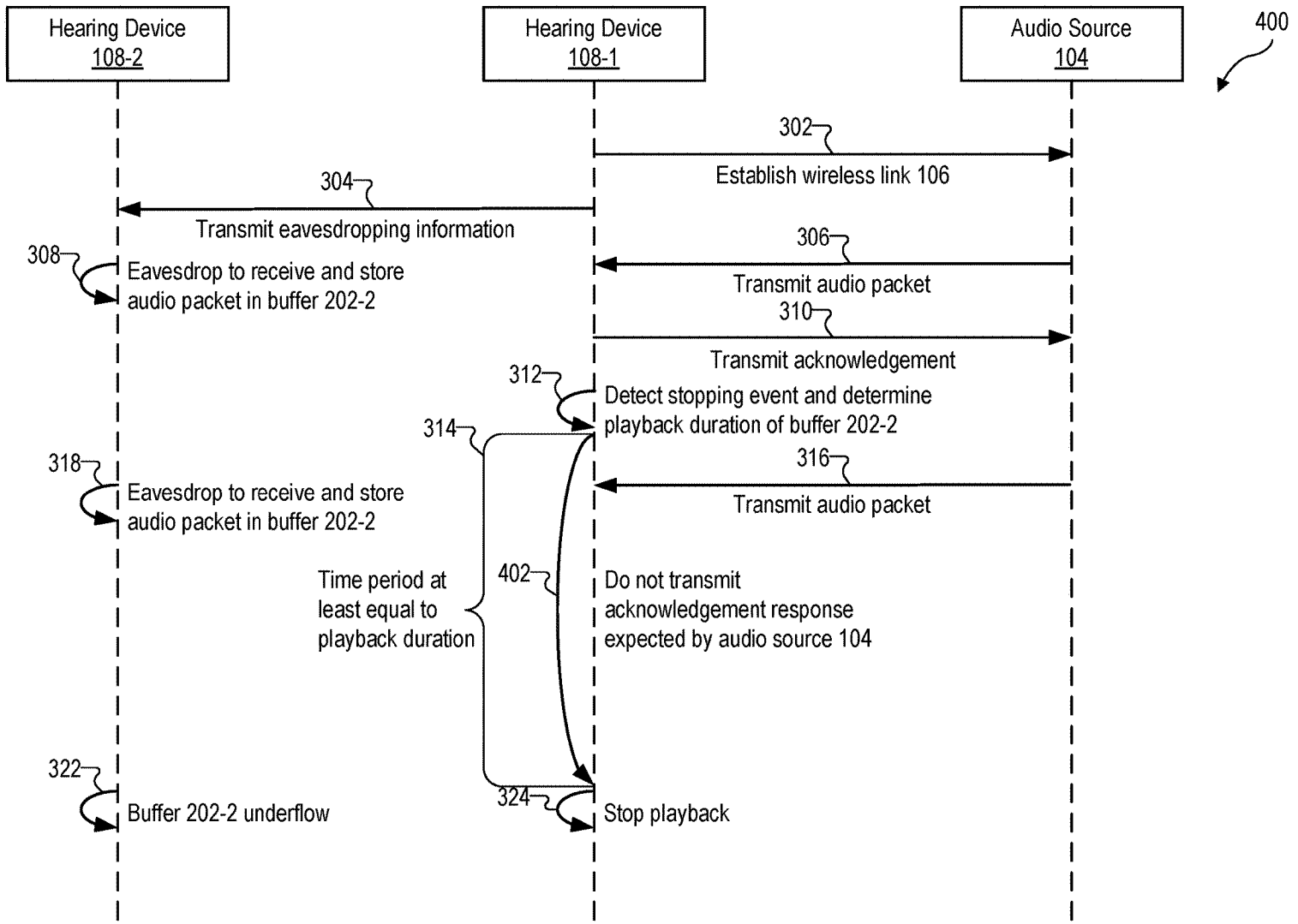

FIG. 4 shows an exemplary sequence diagram 400 that is similar to sequence diagram 300, but that illustrates a different way in which hearing device 108-1 abstains from acknowledging successful receipt of the audio packet transmitted by audio source 104 in operation 316. As indicated by operation 402, instead of transmitting a negative acknowledgement (operation 320 in FIG. 3), hearing device 108-1 does not transmit an acknowledgement response expected by audio source 104 during the time period at least equal to the playback duration of buffer 202-2. Audio source 104 may therefore abstain from transmitting additional audio packets 104 to hearing device 108-1 over wireless link 106 during this time period.

As mentioned, hearing device 108-1 may abstain from acknowledging successful receipt of an audio packet transmitted by audio source 104 for a time period at least equal to the playback duration of buffer 202-2. However, in some examples, hearing device 108-1 may not be aware of the exact playback duration of buffer 202-2 when hearing device 108-1 detects the stopping event. For example, hearing device 108-1 may detect the stopping event while wireless link 110 is disabled, thereby preventing hearing device 108-1 from receiving information indicative of the playback duration of buffer 202-2 from hearing device 108-2. As another example, latency associated with wireless link 110 may prevent hearing device 108-1 from having up-to-date information indicative of the playback duration of buffer 202-2 when hearing device 108-1 detects the stopping event.

In any of these cases, hearing device 108-1 may be configured to abstain from acknowledging successful receipt of an audio packet transmitted by audio source 104 for a time period that is greater than the playback duration of buffer 202-2. For example, hearing device 108-1 may be configured to abstain from acknowledging successful receipt of an audio packet transmitted by audio source 104 for a time period that is at least equal to a maximum possible playback duration of buffer 202-2. In this manner, hearing device 108-1 made ensure underflow of buffer 202-2 before again acknowledging successful receipt of audio packets transmitted by audio source 104.

Regardless, the amount of time between when hearing device 108-1 detects the stopping event and when hearing device 108-2 stops rendering the streaming audio from audio source 104 in accordance with the systems and methods described herein is relatively fast compared to conventional techniques in which a stop command is transmitted by hearing device 108-1 to hearing device 108-2 over wireless link 110. For example, if the maximum possible playback duration of buffer 202-2 is 200 ms, the maximum amount of time it takes for hearing device 108-2 to stop rendering the streaming audio from audio source 104 is about 200 ms. In contrast, as mentioned above, it may take 300 ms or more for hearing device 108-2 to stop rendering the streaming audio in response to receiving a stop command from hearing device 108-1 over wireless link 110.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A hearing system, comprising:

a first hearing device configured to render streaming audio from an audio source by establishing a wireless link with the audio source, and receiving audio packets transmitted from the audio source over the wireless link in accordance with an acknowledgement-based transmission protocol, a second hearing device configured to render the streaming audio from the audio source by eavesdropping on the wireless link to receive the audio packets while the audio packets are being streamed from the audio source over the wireless link, and storing the audio packets in a buffer, the buffer having a playback duration based on a total number of audio packets currently stored in the buffer, and wherein, to stop the second hearing device from rendering the streaming audio, the first hearing device is further configured to abstain, for a time period at least equal to the playback duration of the buffer, from acknowledging successful receipt of an audio packet transmitted by the audio source over the wireless link.

2. The hearing system of claim 1, wherein the first hearing device is configured to abstain from acknowledging successful receipt of the audio packet transmitted by the audio source over the wireless link by transmitting, during the time period, a negative acknowledgement to the audio source.

3. The hearing system of claim 1, wherein the first hearing device is configured to abstain from acknowledging successful receipt of the audio packet transmitted by the audio source over the wireless link by not transmitting, during the time period and in response to successfully receiving the audio packet, an acknowledgment response expected by the audio source.

4. The hearing system of claim 1, wherein:

the first hearing device is further configured to receive, from the second hearing device over an additional wireless link, data from which the first hearing device derives the playback duration of the buffer such that the playback duration is known to the first hearing device; and the first hearing device is configured to set the time period to a duration that is equal to the known playback duration of the buffer.

5. The hearing system of claim 1, wherein the first hearing device is configured to set the time period to a duration that is at least equal to a maximum possible playback duration of the buffer.

6. The hearing system of claim 1, wherein the second hearing device is further configured to render the streaming audio from the audio source by playing back the audio packets from the buffer.

7. The hearing system of claim 6, wherein at a completion of the time period, the buffer does not include any audio packets for the second hearing device to play back.

8. The hearing system of claim 1, wherein:

the second hearing device is configured to receive eavesdropping instructions from the first hearing device over an additional wireless link; and the eavesdropping is based on the eavesdropping instructions.

9. The hearing system of claim 1, wherein the first hearing device is further configured to render the streaming audio from the audio source by storing the audio packets in an additional buffer.

10. The hearing system of claim 1, wherein:

the first hearing device is configured to detect a stopping event; and the first hearing device is configured to stop the second hearing device from rendering the streaming audio in response to the stopping event.

11. The hearing system of claim 1, wherein the first and second hearing devices are each one of a hearing aid, a sound processor included in a cochlear implant system, a head-worn headset, and an ear-worn ear-bud.

12. The hearing system of claim 1, wherein the first hearing device is further configured to stop rendering the streaming audio upon completion of the time period.

13. A hearing device, comprising:

a memory storing instructions;

a processor communicatively coupled to the memory and configured to execute the instructions to:

establish a first wireless link with an audio source that provides streaming audio, receive audio packets transmitted from the audio source over the first wireless link in accordance with an acknowledgement-based transmission protocol, transmit, over a second wireless link, eavesdropping instructions to a second hearing device, the eavesdropping instructions allowing the second hearing device to render the streaming audio from the audio source by eavesdropping on the first wireless link to receive the audio packets while the audio packets are being streamed from the audio source over the first wireless link, and storing the audio packets in a buffer by the second hearing device, the buffer having a playback duration based on a total number of audio packets currently stored in the buffer, and stop the second hearing device from rendering the streaming audio by abstaining, for a time period at least equal to the playback duration of the buffer, from acknowledging successful receipt of an audio packet transmitted by the audio source over the first wireless link.

14. The hearing device of claim 13, wherein the processor is configured to abstain from acknowledging successful receipt of the audio packet transmitted by the audio source over the first wireless link by transmitting, during the time period, a negative acknowledgement to the audio source.

15. The hearing device of claim 13, wherein the processor is configured to abstain from acknowledging successful receipt of the audio packet transmitted by the audio source over the first wireless link by not transmitting, during the time period and in response to successfully receiving the audio packet, an acknowledgment response expected by the audio source.

16. The hearing device of claim 13, wherein the processor is further configured to execute the instructions to:

receive, over the second wireless link, data from which the processor derives the playback duration of the buffer such that the playback duration is known to the processor; and set the time period to a duration that is at least equal to the known playback duration of the buffer.

17. The hearing device of claim 13, wherein the processor is further configured to execute the instructions to set the time period to a duration that is at least equal to a maximum possible playback duration of the buffer.

18. A method comprising:

establishing, by a first hearing device, a first wireless link with an audio source that provides streaming audio;

receiving, by the first hearing device, audio packets transmitted from the audio source over the first wireless link in accordance with an acknowledgement-based transmission protocol;

transmitting, by the first hearing device over a second wireless link, eavesdropping instructions to a second hearing device, the eavesdropping instructions allowing the second hearing device to render the streaming audio from the audio source by eavesdropping on the first wireless link to receive the audio packets while the audio packets are being streamed from the audio source over the first wireless link, and storing the audio packets in a buffer by the second hearing device, the buffer having a playback duration based on a total number of audio packets currently stored in the buffer; and stopping, by the first hearing device, the second hearing device from rendering the streaming audio by abstaining, for a time period at least equal to the playback duration of the buffer, from acknowledging successful receipt of an audio packet transmitted by the audio source over the first wireless link.

19. The method of claim 18, wherein the abstaining from acknowledging successful receipt of the audio packet transmitted by the audio source over the first wireless link comprises transmitting, during the time period, a negative acknowledgement to the audio source.

20. The method of claim 18, wherein the abstaining from acknowledging successful receipt of the audio packet transmitted by the audio source over the first wireless link comprises not transmitting, during the time period and in response to successfully receiving the audio packet, an acknowledgment response expected by the audio source.

* * * * *